US005760542A

United States Patent [19]

Bechtel et al.

[11] Patent Number: 5,760,542

[45] Date of Patent: Jun. 2, 1998

[54] COLOR DISPLAY DEVICE HAVING SHORT DECAY PHOSPHORS

[75] Inventors: Helmut Bechtel, Roetgen; Wolfram Czarnojan; Markus Haase, both of Aachen, all of Germany

[73] Assignee: U.S. Philips Corporation, New York, N.Y.

[21] Appl. No.: 715,257

[22] Filed: Sep. 16, 1996

Related U.S. Application Data

[63] Continuation of Ser. No. 229,975, Apr. 19, 1994, abandoned.

[30] Foreign Application Priority Data

Apr. 20, 1993 [DE] Germany ..... 43 12 737.1

[51] Int. Cl.[6] ..... H01J 1/62; H01J 63/04; G09G 3/34; G09G 3/10

[52] U.S. Cl. ..... 313/491; 313/504; 315/169.1; 345/76; 252/301.6 F; 252/301.6 R

[58] Field of Search ..... 315/169.1; 345/76, 345/147; 313/504–509, 511, 512

[56] References Cited

U.S. PATENT DOCUMENTS

| | | | |
|---|---|---|---|
| 3,623,994 | 11/1971 | Royce et al. . | |
| 3,885,196 | 5/1975 | Fischer | 313/498 |
| 3,935,499 | 1/1976 | Oess | 313/495 |
| 4,042,854 | 8/1977 | Luo et al. | 313/505 |
| 4,114,070 | 9/1978 | Asars | 313/505 |
| 4,646,079 | 2/1987 | Kita et al. | 315/169.3 |
| 4,689,520 | 8/1987 | Kuboniwa | 313/468 |
| 4,715,687 | 12/1987 | Glass et al. | 313/486 X |
| 4,924,139 | 5/1990 | Morita et al. | 313/468 |
| 5,015,912 | 5/1991 | Spindt et al. | 313/495 |
| 5,075,591 | 12/1991 | Holmberg | 313/495 |
| 5,153,483 | 10/1992 | Kishino et al. . | |
| 5,223,766 | 6/1993 | Nakayama | 313/495 |
| 5,262,698 | 11/1993 | Dunham | 345/147 X |
| 5,300,862 | 4/1994 | Parker | 345/76 X |
| 5,378,963 | 1/1995 | Ikeda | 313/495 |
| 5,384,517 | 1/1995 | Uno | 313/499 |

FOREIGN PATENT DOCUMENTS

| | | | |
|---|---|---|---|
| 2093269 | 8/1982 | Germany | H01J 29/18 |
| 3132946 | 3/1983 | Germany | C09K 11/475 |
| 4112078 | 10/1991 | Germany . | |

OTHER PUBLICATIONS

Luminscence of Solids by Humboldt W. Leverng Published by John Wiley & Sons 1950.

"A New $Ce^3$–Activated Phosphor: $LaGaS_3$", by Takeda et al. Jrn. J. Appl. Phys. vol. 19 (1980), No. 8.

*Primary Examiner*—Sandra L. O'Shea
*Assistant Examiner*—Mack N. Haynes
*Attorney, Agent, or Firm*—John C. Fox

[57] ABSTRACT

A color display device, with an electron beam source and with an arrangement of pixels defined by blue, green and red-luminescing material, and including means for exciting the pixels, by scanning the pixel arrangement with excitation pulses a line at a time, exhibits enhanced luminance, is enhanced at a given radiation power and improved linearity of the luminance in dependence upon the electron energy density, by using luminescent materials at least two of which have a luminescence decay time shorter than the excitation pulse lengths.

10 Claims, 2 Drawing Sheets

COLOR DISPLAY DEVICE HAVING SHORT DECAY PHOSPHORS

This is a continuation of application Ser. No. 08/229,975, now abandoned, filed Apr. 19, 1994.

BACKGROUND OF THE INVENTION

The invention relates to a colour display device, and with an arrangement of pixels defined by blue, green and red-luminescing material, and including electron beam source means for exciting the pixels, the exciting means being operable for scanning the pixel arrangement with excitation pulses under line-at-a time scanning conditions.

A colour display device of this type is described in DE-OS 41 12 078.

In such flat-panel colour display devices, only low anode voltages of approximately 1 to 10 kV are available for generating light. Consequently, the electrons penetrate the luminescent materials less deeply than in the conventional display devices of the cathode ray tube types. The achievable luminance is relatively small. The linearity of the luminance in dependence upon the excitation energy density deteriorates with a decreasing anode voltage.

OBJECTS AND SUMMARY OF THE INVENTION

It is an object of the invention to enhance the luminance of a colour display device of the type described in the opening paragraph at a given radiation power. It is another object of the invention to improve the linearity of the luminance in dependence upon the electron energy density.

These objects are achieved in that at least two of the luminescent materials luminescing in the colours blue, green and red have a luminescence decay time shorter than the excitation pulse lengths.

A characteristic feature of colour display devices of the type described in the opening paragraph is that due to the specific scanning method, the excitation period of a red, green or blue-luminescing pixel is considerably extended as compared with conventional cathode ray tubes. In colour display devices according to the invention, a multitude of pixels is excited simultaneously during the overall excitation period, for example during a line period. The excitation period of a pixel covers, for example, one line period (64 μs for PAL), or a period (spot dwell time) in the range of from 10 to 60 μsec for plasma panel type displays and field emission type displays, whereas a pixel in a cathode ray tube is excited for several hundred ns only.

The invention is based on the recognition that for the display devices under consideration, the maximum luminance at a satisfactory linearity can be achieved with those luminescent materials which have a sufficiently short decay time of the luminescence. Then the excitation energy is converted into luminescence light with a satisfactory efficiency and at a high energy density.

The decay time in the sense of the present invention is understood to mean the time in which the intensity of the emitted light decreases to 36% (1/e times 100%) of its initial value.

It is not absolutely necessary for the invention that the decay times of all three luminescent materials used are equally short. Satisfactory white luminances are achieved when only two luminescent materials are chosen for very short decay times (substantially shorter than the excitation pulse lengths), while the decay time of the third luminescent material may be chosen to be substantially equal or larger than the excitation pulse lengths, but it should not be chosen to be too long. For example, it should be less than 300 μsec if the decay time of the two others is shorter than 60 μsec, or less than 60 μsec if the decay time of the two others is less than 2 μsec.

Very high luminances were achieved with center-luminescent materials. Center-luminescent means that the emission is caused by an electron transition occurring at an atom or ion in the crystal lattice. This transition may principally also take place when the centre is present in the free space rather than in a crystal lattice. Rare earth (e.g. $Ce^{3+}$ or $Eu^{2+}$) activated phosphors especially alkaline earth sulfides with inner *4f* transitions only are examples of center-luminescent materials. Preferably, the center concentration in such materials is larger than 0.01 mole percent.

According to a preferred embodiment, a very linear luminance characteristic is obtained if at least two of the luminescent materials of different colour have a decay time of less than 2 μsec. In this case the third luminescent material may have a decay time of less than 60 μsec.

In the framework of the invention very good luminescent materials are based on: ZnS:Ag (for use as a blue-luminescing material), CaS:Ce (for use as a green-luminescing material) and $Y_2O_2S$:Eu or $Y_2O_3$:Eu or CaS:Eu (for use as a red-luminescing material), especially if two or three of them are combined. Additional luminescent materials which are suitable for use in the invention are $Y_2SiO_5$:Ce for the blue luminescent material, and $Y_2SiO_5$:Tb and YAGaG:Tb for the green luminescent material.

BRIEF DESCRIPTION OF THE DRAWING

These and other aspects of the invention will be apparent from and the embodiments described hereinafter, as elucidated with reference to the drawings, in which.

DESCRIPTION OF THE PREFERRED EMBODIMENTS

Figure 1:
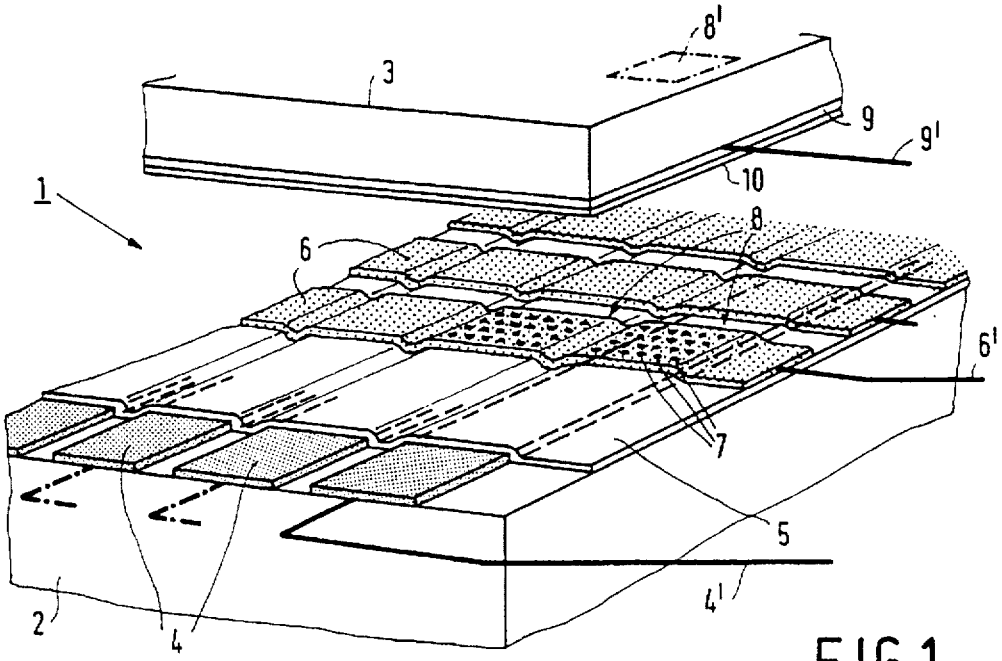
FIG. 1 shows diagrammatically a part of a known display device.

FIG. 1 shows diagrammatically a part of a display device 1, based on field emission. This device comprises two facing glass substrates 2 and 3. The substrate 2 comprises a first pattern of parallel conductors 4 of, for example, tungsten or molybdenum which function as row electrodes in this case. With the exception of the areas near the ends 4' of the row electrodes, where they are exposed for the purpose of connection to external contacts, the entire device is coated with an insulating layer 5 of silicon oxide. Column electrodes 6 of, for, example molybdenum, having a plurality of apertures 7 at the location of the crossings with row-electrodes 4 extend across the insulating layer 5 perpendicularly to the row electrodes 4. In these apertures, which extend through the thickness of the subjacent insulating layer, a plurality of field emitters is realised on the row electrodes 4. These field emitters are usually tip-shaped, conical or pointed. The pixels 8' correspond to areas 8 of the crossings of the row and column electrodes.

The substrate 3 has a transparent anode layer 9 formed of ITO which is provided with a luminescent screen 10 formed of luminescent stripes or dots. By giving the electrode 9 (anode) a sufficiently high voltage, electrons emitted by the field emitters are accelerated towards the substrate 3 (the face plate) where they cause a part 8' of the phosphor pattern corresponding to an area 8 to luminesce. The quantity of emitted electrons can be modulated with voltages across grid electrodes integrated to column electrodes 6, via connections 6'.

Figure 2:
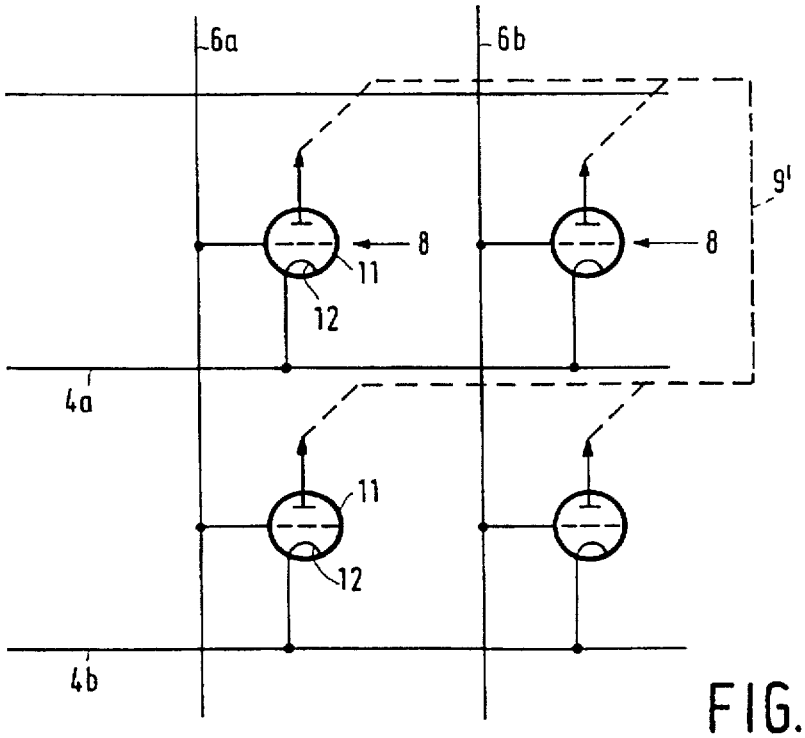
FIG. 2 shows the device of FIG. 1 in an electric circuit diagram.

FIG. 2 is a simplified representation of an equivalent circuit diagram of the display device of FIG. 1. In FIG. 2 the electron emitter areas 8 are shown by means of triodes 11, a cathode 12 of which is always formed by the field emitters associated with a pixel, while a grid is formed by the part of a column electrode which is provided with apertures 7 at the location of a crossing with a row electrode. The anode 9 is common for all triodes 11, which is diagrammatically shown in FIG. 2 by means of a plane 9' in broken lines.

During operation the row electrodes *4a*,*4b* are selected during successive selection periods while a data signal is presented to the column electrode *6a*, which together with the signal at the row electrodes *4a*,*4b* defines the voltage across the field emitters at the location of the crossings and hence the field emission and consequently the light intensity of the pixels 8'. After the selection period has elapsed, the row electrodes receive a voltage of (for example) 0 Volt, so no longer any field emission in the relevant rows occurs.

The quantity of emitted electrons should be sufficient to cause the pixels 8' to luminesce in the correct way. In this specific embodiment the selection period (32 μsec) is short with respect to a frame period (20 msec).

Figure 3:
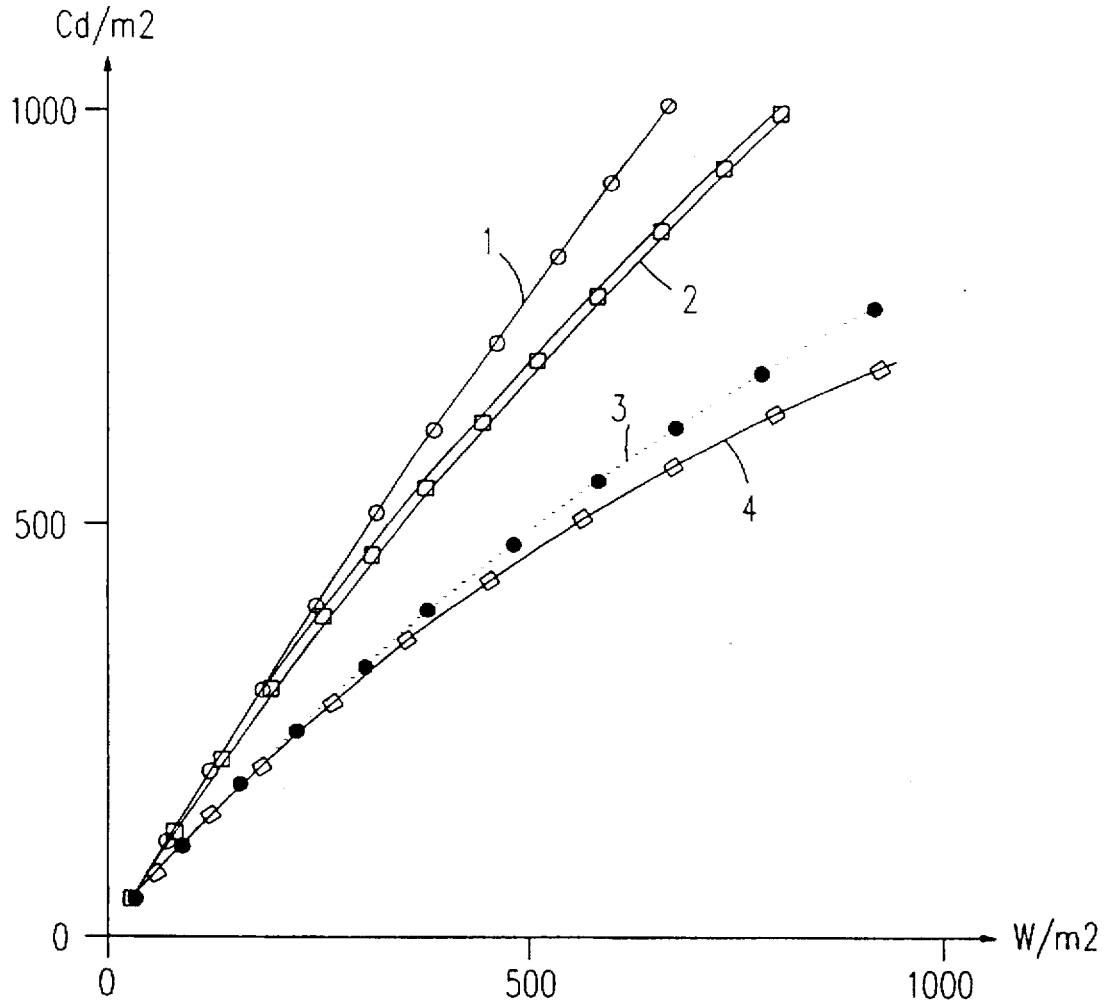
FIG. 3 shows graphically the luminances in $Cd/m^2$ for 4 different luminescent material combinations in dependance upon the electrical power density in $W/m^2$.

The characteristic curves in FIG. 3 represent the D65 white luminances in dependence upon the electrical screen power density for various luminescent material combinations. The same experimental conditions were maintained:

electron acceleration voltage: 5 kV duration of the excitation pulses: 15 μsec repetition frequency of the excitation pulses: 50 Hz.

The luminance values were measured through glass with a transmission of approximately 50%. 50% of the display area was coated with luminescent material and the rest was blackened for increasing the contrast (black matrix). For small luminescent material components, as is desirable for the effect of contrast, the advantageous effect of the teachings according to the invention are found to a very high degree.

No aluminium backing layer was provided during the tests. The advantages of the invention are, however, also apparent when aluminium backing layers are used or when other known measures are taken to increase the light output.

The characteristic curves 1 to 4 were measured with the following luminescent material combinations-each time in the sequence blue, green, red: characteristic curve 1: ZnS:Ag, CaS: Ce, CaS: Eu characteristic curve 2: ZnS:Ag, CaS: Ce, $Y_2O_2S$: Eu (or $Y_2O_3$:Eu) characteristic curve 3: ZnS:Ag, $Y_2SiO_5$:Tb, $Y_2O_2S$: Eu (or $Y_2O_3$:Eu), characteristic curve 4: ZnS:Ag, ZnS: Cu, $Y_2O_2S$: Eu (or $Y_2O_3$:Eu). The luminescent materials in accordance with characteristic curve 4 constitute a standard combination conventionally used for colour display tubes of the prior art. Luminescent materials in accordance with characteristic curve 3 use $Y_2SiO_5$:Tb instead of ZnS: Cu as a green-luminescing material. This leads to a slight increase of luminance as compared with characteristic curve 4, and a somewhat better linearity.

However, high luminance values and substantial linearity were achieved with the combinations as represented by characteristic curves 2 and 1 particularly 1.

The decay times of the used luminescent materials used are:

ZnS:Ag:1 μs

CaS:Ce:0.5 μs CaS:Eu :1 μs $Y_2O_2S$:Eu and $Y_2O_3$:Eu:200 μs

ZnS:Cu:10 μs.

The most important fundamental dopants are indicated for the luminescent materials. It is of course possible to provide additional dopants in the known manner so long as the decay times to be adhered to according to the invention are not exceeded. It is appropriate to tune the compositions of the alkaline earth sulphides such that for the luminescent materials based on CaS:Ce the colour coordinates lie in the ranges between $0.30<x<0.38$ and $0.54<y<0.59$ and for CaS:Eu in the ranges between $0.57<x<0.70$ and $0.29<y<0.39$.

We claim:

1. A color display device, comprising an arrangement of display pixels defined by blue, green and red-luminescing materials, and means for simultaneously exciting the pixels in a line with excitation pulses during a line period, characterized in that at least two of the luminescent materials have a luminescence decay time which is substantially shorter than the excitation pulse lengths.

2. A colour display device as claimed in claim 1, characterized in that the luminescence decay time is less than 60 μsec.

3. A colour display device as claimed in claim 1, characterized in that the luminescence decay time is less than 10 μsec.

4. A colour display device as claimed in claim 1, characterized in that at the luminescence decay time is less than 2 μsec.

5. A color display device as claimed in claim 1, characterized in that the luminescent materials are center-luminescent materials.

6. A color display device as claimed in claim 1, characterized in that the blue-luminescing material has a composition selected from the group consisting of ZnS: Ag and of $Y_2SiO_5$:Ce.

7. A color display device as claimed in claim 1, characterized in that the green luminescing material has a composition selected from the group consisting of CaS: Ce, $Y_2SiO_5$: Tb and YAGaG: Tb.

8. A color display device as claimed in claim 1, characterized in that the red-luminescing material has a composition selected from the group consisting of $Y_2O_2S$: Eu, $Y_2O_3$: Eu and CaS: Eu.

9. A color display device as claimed in claim 1, characterized in that the green and/or the red luminescing material comprises a rare earth activated alkaline earth sulphide phosphor.

10. A color display device as claimed in claim 5, characterized in that the center concentration is larger than 0.01 mole %.

* * * * *